US008162768B2

(12) United States Patent
Nemeth et al.

(10) Patent No.: US 8,162,768 B2
(45) Date of Patent: Apr. 24, 2012

(54) TELESCOPING-ARM ROUND RIDE FOR AMUSEMENT PARKS

(75) Inventors: Edward A. Nemeth, Hermosa Beach, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 151 days.

(21) Appl. No.: 12/819,328

(22) Filed: Jun. 21, 2010

(65) Prior Publication Data

US 2011/0312428 A1 Dec. 22, 2011

(51) Int. Cl.
*A63G 1/28* (2006.01)
*A63G 1/00* (2006.01)

(52) U.S. Cl. ..... 472/39; 472/130

(58) Field of Classification Search ..... 472/6, 7, 472/9, 11, 32–34, 39, 45, 47, 59, 130
See application file for complete search history.

(56) References Cited

U.S. PATENT DOCUMENTS

| | | | | |
|---|---|---|---|---|
| 2,282,763 | A * | 5/1942 | Kennedy | 472/39 |
| 4,898,377 | A * | 2/1990 | Roche | 472/30 |
| 5,558,581 | A | 9/1996 | Knijpstra | |
| 6,776,722 | B2 * | 8/2004 | De-Gol | 472/59 |
| 8,062,142 | B2 * | 11/2011 | Underbrink et al. | 472/113 |
| 2008/0113822 | A1 | 5/2008 | Kitchen et al. | |

FOREIGN PATENT DOCUMENTS

| | | |
|---|---|---|
| DE | 364146 | 11/1922 |
| DE | 3431684 A1 | 3/1986 |
| FR | 906416 | 1/1946 |
| GB | 248240 | 3/1926 |
| GB | 852577 | 10/1960 |
| GB | 2278291 | 11/1994 |

OTHER PUBLICATIONS

European Search Report for Appl. No. EP11170603, dated Oct. 25, 2011, from the European Patent Office.
www.fabbrigroup.com, Daytona Round Ride, retrieved on Jun. 21, 2010, Fabbri Group, 45032 Italy.

* cited by examiner

*Primary Examiner* — Kien Nguyen
(74) *Attorney, Agent, or Firm* — Marsh Fischmann & Breyfogle LLP; Kent A. Lembke

(57) ABSTRACT

An amusement park ride that provides an interactive flying experience in a round ride setting by allowing vehicle passengers to move their vehicle in and out horizontally through a fly zone. The ride includes a central support assembly with a structure rotatable about a central axis at one or more rotation speeds. The ride also includes passenger vehicles and, for each vehicle, a support arm assembly that extends outward from the rotatable structure. The support arm assembly includes a support arm and a variable radius mechanism. The support arm is mounted to the rotatable structure and supports the passenger vehicle. The variable radius mechanism operates during rotation of the rotatable structure to vary the arm length or support location of the vehicle on the arm to vary the vehicle's rotation radius. The variable radius mechanism may include a telescoping arm that reciprocates the vehicle along a linear displacement path.

23 Claims, 5 Drawing Sheets

TELESCOPING-ARM ROUND RIDE FOR AMUSEMENT PARKS

BACKGROUND

1. Field of the Description

The present description relates, in general, to amusement park rides and other entertainment rides such as round iron rides, and, more particularly, to amusement or theme park rides configured to provide passengers with an additional degree of freedom of movement and/or increased interactivity and control as compared with conventional round rides where speed of rotation and height of a passenger compartment are typically the varying ride characteristics.

2. Relevant Background

Amusement and theme parks are popular worldwide with hundreds of millions of people visiting the parks each year. Park operators continuously seek new designs for rides that attract and continue to entertain guests. Many parks include round iron rides that include vehicles or gondolas mounted on support arms extending outward from a centrally located drive or rotation assembly. The guests sit in the vehicles and are rotated in a circle about the drive assembly, which spins about its central axis. In some of these rides, the guests may operate an interactive device, such as a joystick in the vehicle, to make the support arm and their attached vehicle lift upward and, later, drop back downward. In other words, the angle of the support arm relative to the ground may be changed by the guest while the vehicle spins about a central rotation axis at a fixed radius (i.e., the length of the support arm) and at a constant speed.

While these rides are often very popular with younger children, these rides are typically not considered a thrill ride for the older guests as the rides often rotate at less than 10 revolutions per minute (RPM). When designing new rides, park operators have a great amount of freedom to develop thrill rides with very different configurations such as roller coasters and the like that allow the guests to travel at high speeds and experience high accelerations as their vehicles travel around corners and dips. However, park operators face a different challenge when they attempt to refurbish or modify an existing round iron ride to create a ride that will attract older guests but that yet can be provided in the same space constraints or have the same footprint, i.e., a ride provided within the same circular area used by the original round iron ride. Even more attractive to the park operator would be a ride configuration that made use of at least some of the original ride components such as the circular drive assembly as this significantly reduces start up costs and allows continued use of a proven drive system. Alternatively, it is desirable to create a new round ride that makes use of a portion of the round ride (such as the rotating center structure and arm pivot assembly) so that these aspects do not have to be newly designed, engineered, and tested and such that new rides with small foot print, low cost/risk, and medium capacity can be provided to guests.

Hence, there remains a need for a round ride designed to provide a more exciting, thrilling, and engaging experience. In some cases, the round ride would also provide enhanced interactivity for the vehicle passengers. However, the relatively low rotation rate of the drive assembly and the typically fixed seating orientation of the guest has been a significant barrier to the amount of thrill or excitement that could be provided in the past with a ride based on a round iron ride design, and any new design should attempt to provide a varying experience that attracts repeat use by guests visiting an amusement park without requiring radical and/or expensive changes to the base configuration.

SUMMARY

The present description addresses the above problems by providing a park ride that includes a central support and rotation assembly similar to those found in traditional round iron rides to rotate a hub or support structure about a rotation axis. A number of passenger vehicles are supported at the end of support arm assemblies, with each support arm assembly being pivotable through a range of arm angles (or angular orientations of the support arm assembly). To vary the experience, each support arm assembly includes a variable radius mechanism or arm actuator that allows the radius at which each vehicle is rotated about the hub's rotation axis to be varied during ride operations (e.g., during rotation and during the pivoting of the support arm assembly up and down).

In some embodiments, the support arm assembly includes a pivoting arm pivotally connected to the hub structure and a telescoping arm extending outward from the pivoting arm to support the vehicle. An actuator is provided to reciprocate or telescope the telescoping arm along a linear path to vary or dynamically define the vehicle radius (or the length of the arm assembly). In some cases, the variable radius mechanism includes a track or fixed rack gear on a support arm and a drive mechanism in the vehicle to move the vehicle linearly along the length of the support arm to set the vehicle radius. To provide user interaction, the passenger of the vehicle may operate an input device (such as a joystick or the like) to cause their vehicle to be moved horizontally (i.e., to change the vehicle radius by operating the arm actuator) as well as changing the height or angular orientation of the support arm.

More particularly, an amusement park ride is provided that creates an interactive flying experience in a round ride setting but with vehicles that may be moved horizontally and not just vertically through a work space or fly zone. The ride includes a central support assembly with a structure rotatable about a central axis at one or more rotation speeds. The ride also includes a number of passenger vehicles. For each of the passenger vehicles, a support arm assembly is provided that extends outward from the rotatable structure. The support arm assembly includes a support arm and a variable radius mechanism (or arm actuator). The support arm is mounted to the rotatable structure and supports the passenger vehicle at a distance from the rotatable structure. The variable radius mechanism operates during rotation of the rotatable structure to vary the distance such that a radius the vehicle is rotated about the central axis is varied during operation of the amusement park ride.

In some embodiments of the ride, the variable radius mechanism includes a telescoping arm upon which the passenger vehicle is mounted and further includes an actuator. The telescoping arm slidably engages (or is supported to slide linearly on) the support arm and the actuator reciprocating the telescoping arm along a linear displacement path to vary the vehicle radius. The actuator may operate at least in part in response to input received from an input device provided in the passenger vehicle to vary the vehicle radius (e.g., based on movement of a joystick or the like by a passenger). In the ride, the support arm may be pivotally mounted to the rotatable structure and then be pivoted or moved through a range of angular positions by a pivoting assembly, e.g., at least partially concurrently with the operation of the actuator to vary the vehicle radius. Further, in such rides, the actuator may be designed to be operated to reciprocate the telescoping arm at a rate selected from the range of 0 to 15 feet/second, and the passenger vehicle may also be mounted on the telescoping arm to roll with the reciprocating of the telescoping arm (e.g., with "free" rolling and/or with a driven/motorized vehicle roll control device).

In other embodiments of the ride, the variable radius mechanism includes a fixed rack gear provided on a surface of the support arm and also includes a drive mechanism on the passenger vehicle operable (e.g., in response to control signals from a user input device and/or a control system) to move the vehicle along the fixed rack gear to vary the vehicle radius. The ride may also include a control system (e.g., a hardware processor executing code of a ride program and/or managing memory to access ride parameters) that receives ride information from each of the passenger vehicles (such as from an IR detector to detect "hits" from an IR emitter on another one of the vehicles, from a touch screen or other user input device allowing a user to change the vertical and horizontal position of the vehicle, or the like) and, in response, providing system feedback to the passenger vehicles to operate feedback devices on the passenger vehicles (sound, lights, scores, and so on in displays, shuttering/vibrating the vehicle, and the like) and varying operation of the variable radius mechanism (e.g., sudden vertical drops of the vehicle when hit more than a threshold amount or the like).

DETAILED DESCRIPTION OF THE PREFERRED EMBODIMENTS

Embodiments described herein are directed to an amusement park ride in which vehicles are rotated about a rotating central hub or support structure, with each vehicle being supported at a distance (or radius) from this hub that can be varied during the ride. The variable radius for the vehicle may be set by a control system such as to provide a ride experience defined by a ride program run by a control system computer or processor and/or in response to user input so as to provide greater levels of rider/passenger interactivity in the ride. This may be accomplished by giving a passenger direct control over a hydraulic valve or other control/input device, e.g., implemented in the manner of many construction-type machines to extend out an arm or boom.

The inventors recognized that multi-arm round rides have delivered the same experience for decades, but these rides are staples to nearly every amusement or theme park. These rides provide essentially the same guest experience with the most interactive of such rides allowing the riders to control the height of their vehicle while a central hub or arm support structure rotates at a constant speed. The inventors determined that it was possible to modify the base round ride to provide a more exciting, thrilling, and engaging ride experience as well as allow for new gaming opportunities. Such a new round ride may include additional interactive control elements such as to control the distance from the central hub/support structure to the vehicle (variable radius) and/or controls for two or more passengers (e.g., one controlling height, one controlling radius/arm length, and/or one or both controlling other vehicle components such as a weapon in a "dogfight" or similar application). Briefly, the described ride provides unique and new interactive/gaming opportunities by adding a second degree of freedom to the vehicle by providing "horizontal" movement, which greatly expands the work space or fly zone for each vehicle as the vehicle is not limited to a fixed radius with only height or vertical position being varied during rotation.

Figure 1:
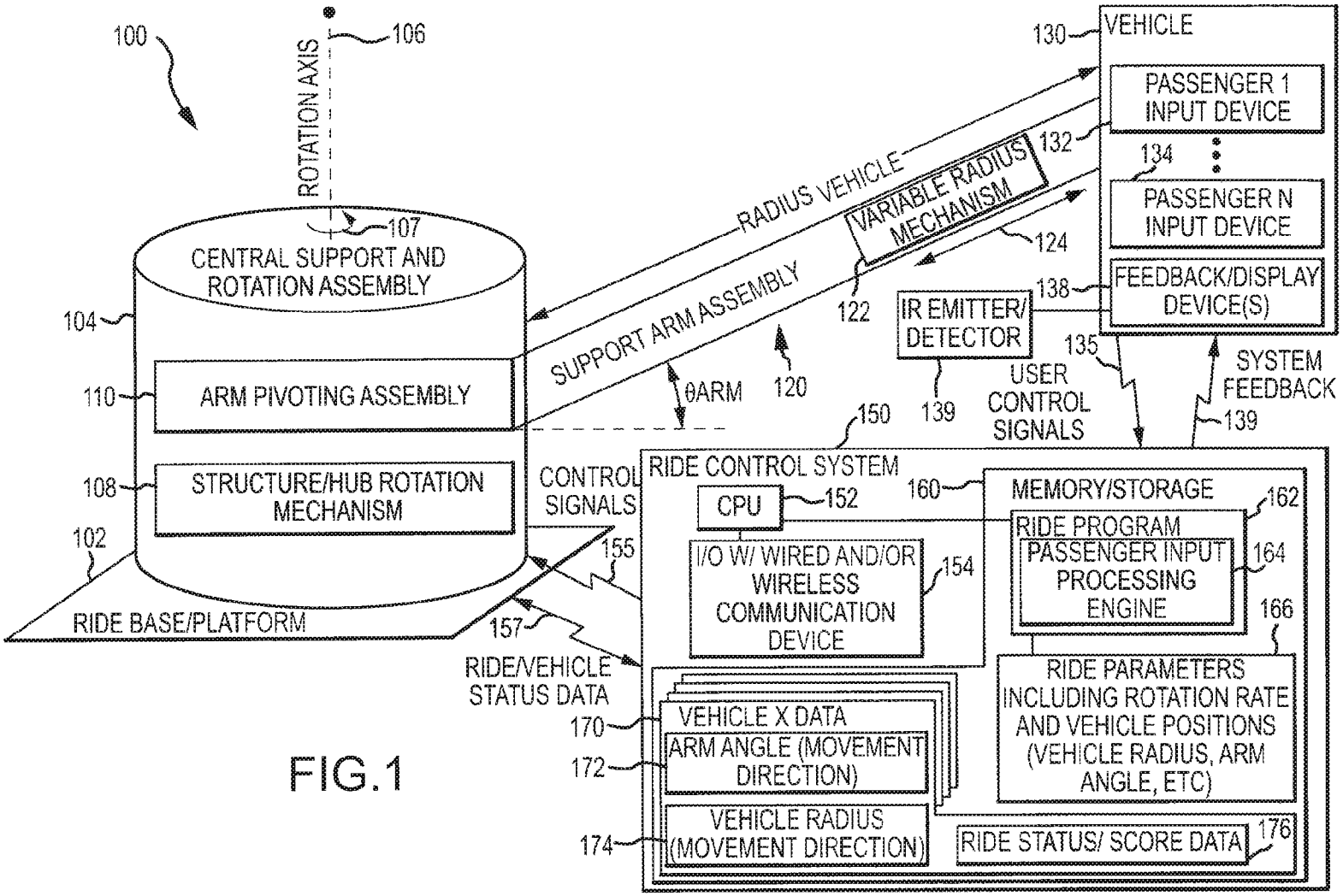
FIG. 1 is a functional block or schematic drawing of an amusement park ride that includes a support arm assembly with a variable radius mechanism, e.g., a telescoping arm operable in response to program ride parameters and/or in response to passenger/rider input to change the length of the support arm (or radius of vehicle relative to rotating hub/central structure)

FIG. 1 illustrates an amusement park ride or round iron ride 100 in functional block or schematic form. The ride 100 generally includes a central support and rotation assembly 104 rotatably supported or mounted on a ride base or platform 102. The central support and rotation assembly 104 includes a structure/hub rotation mechanism 108 that is selectively operable, such as in response to control signals/power 155 from ride control system 150, to rotate 107 the assembly/hub 104 about a central (typically vertical) axis 106. The central support and rotation assembly 104 further includes an arm pivoting assembly 110 that allows the assembly 104 to support and angularly position a plurality of support arm assemblies 120 about the circumference of the hub/structure of assembly 104. In operation, the arm pivoting assembly 110 may operate in response to control signals 155 to set and vary the angle, $\theta_{Arm}$, of the arm assembly 120 so as to change the height or vertical position of a vehicle 130 supported on the arm assembly or support arm 120.

Significantly, the support arm assembly 120 also includes a variable radius mechanism 122 that is operable (again, in response, to control signals 155 from control system 150) to define and/or adjust/change the radius, $\text{Radius}_{Vehicle}$, of the vehicle 130. This is shown with arrow 124 indicating that the vehicle 130 may be reciprocated along a linear displacement path that may be the longitudinal axis of the arm 120 so as to vary the magnitude of the radius, $\text{Radius}_{Vehicle}$, during rotation 107 of the assembly 104 by rotation mechanism 108. For example, the radius, $\text{Radius}_{Vehicle}$, may be chosen to be in the range of about a few feet up to 25 feet or more, and the magnitude of extension/retraction (or amount the radius can be varied by mechanism 122) may be 10 to 15 feet with "horizontal" movement 124 of 2 to 5 feet by mechanism 122 being useful in some rides 100.

Each vehicle 130 may contain seating for one, two, or more passengers/riders with two to four being a common arrangement. Each vehicle 130 may include one or more input devices 132 to 134 such that one passenger or two or more passengers may provide input that can be transmitted in a wired or wireless manner as user control signals 135 to the ride control system 150. For example, one rider's input device 132 may be a joystick-type control that allows the rider to provide vertical height commands and concurrently or separately provide left/right or horizontal commands. These inputs 135 may be processed by the ride control system 150 to operate the arm pivoting assembly 110 to move the arm assembly 120 to change or set the angle, $\theta_{Arm}$, and, thereby, adjust the height or vertical position of the vehicle 130. The signals/input 135 may also be processed by the ride control system 150 so as to operate the variable radius mechanism 122 so as to modify 124 the radius or horizontal position, $\text{Radius}_{Vehicle}$, of the vehicle 130 relative to the hub/central structure 104 (such as by changing the length of the arm 120 or moving/reciprocating the vehicle 130 along the longitudinal axis of the arm 120).

As shown, the ride control system 150 includes a processor or central processing unit (CPU) 152 that manages operation of input/output device 154. These devices 154 may include wired and/or or wireless communication devices for receiving user control data/input 135 and ride/vehicle status data 157 from the vehicles 130 and/or the central support and rotation assembly 104. The ride/vehicle status data 157 may be signals from position sensors and the like indicating the rotational position of the hub/central support 104 as well as its present rotation speed. The data 157 may also include a position of each vehicle 130 including an angular orientation, $\theta_{Arm}$, of the arm 120 and the present/current radius, $\text{Radius}_{Vehicle}$.

The CPU 152 manages memory or data storage 160 and may store the status data 157 in files of vehicle data 170 maintained for each vehicle 130 during each ride or operation of the ride 100. The vehicle data 170 may include the arm angle as well as which direction/speed it is presently moving 172, the vehicle radius and its present movement direction/speed 174, and, in some cases, the ride status/score data 176 for the vehicle and its passengers (e.g., a ride may provide gaming opportunities and the data 176 may include a "health" of the vehicle 130 based on a number of hits it has taken or the like, score based on number of hits it has achieved on other ride vehicles, and the like).

The CPU 152 runs or executes code in the form of one or more ride programs/applications 162, and this program 162 may include a passenger input processing engine 164 that processes input 135 from rider input devices 132, 134 to determine control signals 155 to control vertical and horizontal movement of the vehicle 130 (e.g., to set or adjust the angle, $\theta_{Arm}$, by operating the pivoting assembly 110 and to set or adjust the vehicle radius, $\text{Radius}_{Vehicle}$, by operating the variable radius mechanism 122). The ride program 162 may include or access from memory 160 a set of ride parameters 166 to allow it to generate control signals 155. The ride parameters 166 may set arm angles, $\theta_{Arm}$, and vehicle radii, $\text{Radius}_{Vehicle}$, during portions of a ride such as during load/unload and non-interactive portions of the ride program 162 (e.g., some rides may have periods/portions where the program 162 and its parameters 166 control the vertical and horizontal positioning of each vehicle 130). The ride parameters 166 may be rotation rate (or this may be constant) and vehicle positions at various portions of ride including vehicle radius, arm angle, roll/pitch of the vehicle, and the like. The ride program 162 may also cause the CPU 152 via I/O devices 154 to transmit system feedback 139 to the vehicle 130 such as to cause feedback/display devices 138 on the vehicle 130 to operate to display health/score data 176 or sensory feedback in the form of lights, sounds, vibrations, or the like. The system feedback 139 may also be provided in the form of control signals 155 that cause the vehicle 130 to change its vertical/angular position or its horizontal position such as by rapidly changing the angle, $\theta_{Arm}$, of the arm or radius, $\text{Radius}_{Vehicle}$, of the vehicle 130 (e.g., drop suddenly when "hit" so more than a threshold number of times by another vehicle in the ride 100).

To this end, each vehicle 130 may include an infrared (IR) emitter/detector 139 that allows it to "fire" upon other vehicles 130 (such as the one immediately ahead of them on the assembly 140) and to detect when they are struck/hit by other IR emitters 139. Specifically, by adding the ability to change the vehicle radius, $\text{Radius}_{Vehicle}$, via the input devices 132, 134, the ride 100 is able to provide additional interactivity/gaming opportunities not as applicable to mere changes in height (or arm angle, $\theta_{Arm}$). Each vehicle 130 may be equipped with an IR emitter 139 in the front and an IR detector 139 in the back. The IR arrangement may require fairly accurate alignment between vehicles 130 in order to align the emitter 139 with a detector 139 in the vehicle 130 ahead in the ride 100. The game may be similar to a dogfight and involve matching the vertical and horizontal position of the vehicle 130 ahead of your vehicle 130 while simultaneously avoiding being aligned with the trailing vehicle 130 (e.g., "chasing" the vehicle ahead while trying to "get away" from the vehicle behind). An IR pulse may be emitted whenever a rider pulls a trigger or activates a portion of their input device 132, 134 (and one device 132 may provide both vehicle position and firing capabilities or these functions may be divided among the devices 132, 134 to allow two or more riders to actively engage the game/ride). If the IR pulse hits the detector 139, that vehicle 130 may transmit a control signal 135 to the control system 150 for processing with engine 164 of ride program 162, and, based on ride status 176, the ride program 162 may provide system feedback 139 to operate a feedback/display device 138 and/or send control signals 155 to change the position of the vehicle 130 (e.g., to drop the vehicle a few feet by reducing the arm angle, $\theta_{Arm}$, when they sustain one or more hits).

The ride 100 may be implemented so as to create a new and unique experience for riders using a traditional "round iron ride base" by attaching the vehicle 130 to the rotating 107 center structure 104 through arms 120 that can be pivoted by assembly 110 and that allow the vehicle's radius, $\text{Radius}_{Vehicle}$, to be changed. For example, the variable radius mechanism 122 may be telescoping device/assembly such that the support arm may be telescoping as shown at 124 to change the horizontal position of the vehicle 130. The arm's orientation, $\theta_{Arm}$, and length, $\text{Radius}_{Vehicle}$, may be computer controlled 155 by ride control system 150 to follow a specific show profile defined by ride program 162 and/or parameters 164 and/or be manually determined/adjusted by the passenger through the use of onboard devices 132, 134 to increase interactivity and/or gaming opportunities.

In a retrofit-type application, a fixed-length arm of a traditional multi-arm round ride may be replaced with the support arm assembly 120 such as with a telescoping arm. The addition of the telescoping mechanism 122 on the arm 120 allows the vehicle 130 to be positioned anywhere within a 2-dimensional area (e.g., work space, fly zone, or the like) instead of along a fixed 1-dimensional arc as in existing multi-arm round ride implementations. The rotating center structure 104 with its arm pivoting assembly 110 and rotation mechanism 108 may be similar to these existing rides. For example, but not as a limitation, the assembly 104 may be configured as for a typical round iron ride such as the drive and support assemblies designed and distributed by Zamperla Inc., 49 Fanny Road, Parsippany, N.J., USA or other similar ride design and production companies. Often, such an assembly 104 only operates/rotates 107 at relatively low speeds such as less than about 20 RPM and more typically less than about 10 RPM such as about 9 RPM in some cases. In some cases, the rotation 107 may be in either direction, but, more typically, the ride structure 104 rotates 107 in a single direction, which allows the vehicles 130 to be provided to better simulate forward flight.

The ride 100 includes a number of support arms 120 that are mounted at a first end to the ride structure 104 and extend outward radially from the axis 106. The arms 120 are shown to be linear such as with a rectangular cross section but many other configurations may be used to practice the invention, such as circular cross section arms with a non-linear shape (e.g., wavy, curved, or the like), and the length of the arms typically is 0 to 30 feet or more. A main function of the support arms 120 is to provide a rigid or relatively rigid connection between the ride structure 112 and a set of vehicles (such as vehicles 130, 140, 150 and the others shown in FIG. 1). In some embodiments, the arms 120 are pivotally mounted at first/inner ends such that the angle of the arm 120 may be changed by the structure 112 during the ride, e.g., in response to operation of an interactive device or joystick 132, 134 in the vehicle, in response to manual commands by a ride operator via I/O devices 154, in response to a ride program/signals 155 from ride program 162, or the like. This change in arm angle, $\theta_{Arm}$, causes the second or distal end of the arm 120 (and attached vehicles 130) to move between an initial or minimum operating (or loading) height and an upper or maximum operating height.

In addition to providing a rigid support for setting the vertical height of the vehicle and linking the vehicle to the rotating hub, the arm 120 includes the variable radius mechanism 122. The mechanism 122 allows the radius, $\text{Radius}_{Vehicle}$, to be changed, and it may be implemented as a single degree-of-freedom (DOF) actuator that controls the overall length of the arm 120 as shown with arrow 124, and thereby, defines the vehicle position 130 relative to the hub 104 and within a work space or fly zone. Additional equipment in arm 120 and/or mechanism 122 may include structural mounts, guides, and end of travel stops (e.g., see FIGS. 3 and 7). The arms 120 in ride 100 may be "sprung" or programmed via program 162 to return to their shortest length at the end of a ride for load/unload of the vehicle 130 (as well as to a particular load/unload arm angle, $\theta_{Arm}$).

In one embodiment, the ride 100 is implemented as a "ride by wire" system in which the rider/passenger controls 132, 134 are inputs 135 to a computer system 150, which, in turn, directly interfaces 155, 157 with, and controls, the arm angle, $\theta_{Arm}$, and the arm extension/vehicle radius, $\text{Radius}_{Vehicle}$. This implementation has several advantages in that the computer 152 or control system 150 can be used to: (1) interpret natural, intuitive rider inputs 135 (e.g., move up/down and/or left/right) and automatically translate (via engine 164) those inputs into the correct combination of arm angle and arm extension needed to affect a desired response and (2) vary the vehicle motions independent of rider control to create show effects and/or in response to gaming actions. Riders/passengers may be given direct control of the individual axes (arm angle and arm extension) or, in other cases, given a control interface in devices 132, 134 that allows them to direct the vehicle 130 up, down, left, right, or some combination while the system 150 determines an appropriate arm angle and vehicle radius to affect the desired vehicle movement. For example, if the ride is themed as an airplane, the passenger input device 132, 134 may be a 2-axis joystick that the rider/passenger pushes forward to cause the vehicle 130 to dive, pulls back to cause the vehicle 130 to climb, and moves left or right to move "horizontally" in those directions (by changing vehicle radius, $\text{Radius}_{Vehicle}$). From the rider's perspective, they are able to climb above, drop below, move to the inside, move to the outside, or some combination relative to the vehicles ahead and behind them. Optionally, control of the individual axes (support arm angle/vehicle radius) and/or control of the vehicle position (up/down or left/right) can be separated such that two or more riders may be involved in control of the vehicle position via input devices 132, 134, with each rider having direct control over one of the controlled elements (or of another element such as the "weapon" of the game/ride).

Figure 7:
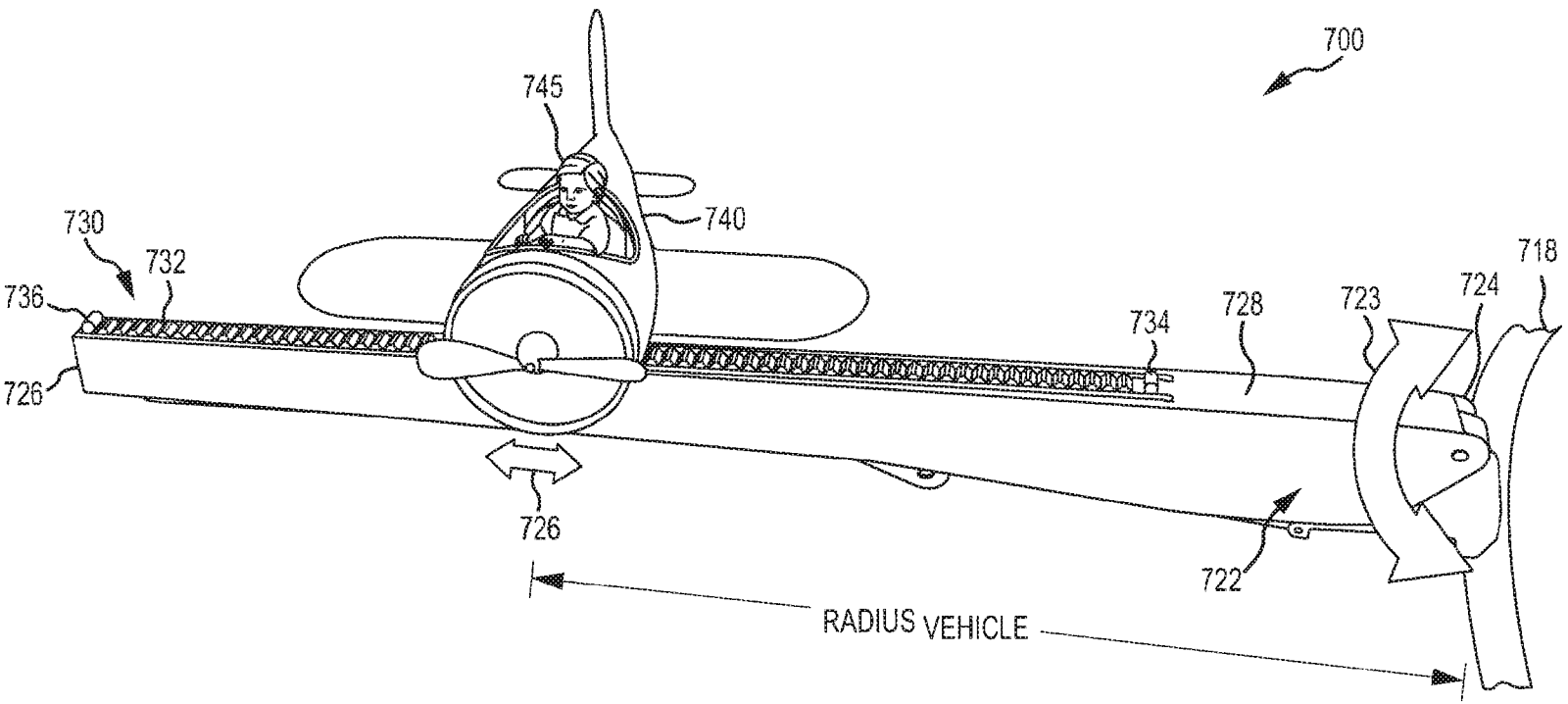
FIG. 7 illustrates a partial front view of another embodiment of a park ride similar to that shown in FIG. 3 but providing an alternative technique for providing a variable radius mechanism for a support arm assembly (e.g., a fixed rack provided on a surface of the support arm combined with a driven pinion or the like in the vehicle).

The rides described herein such as ride 100 support various gaming options providing a more dynamic and intuitive motion platform in a round ride package and a platform that is able to respond to external events. One example of a gaming experience is an airplane style "dog fight" in which a vehicle passenger tries to line up with the vehicle ahead of them by moving left, right, up, and/or down and to shoot the tail of the vehicle ahead of them. The passenger also may have to avoid having the rider/vehicle behind them lining up on their tail or vehicle. A vehicle may respond physically such as by dropping a few feet or shuttering/vibrating when it is hit (or after a number of such hits). In some cases, the support arm assembly 120 may include a second pivot arm at the end of the primary pivoted arm to essentially create a 2-axis robotic arm (e.g., the variable radius mechanism 122 may not only change the horizontal position of the vehicle 130 but may also change the vertical position or height). In other cases (as shown in FIG. 7), the variable radius mechanism 122 is provided, in part, by incorporating a drive system within or on the vehicle 130 that allows the vehicle 130 to be moved back and forth (or reciprocated) on the arm 120 such as on a track or other device on a surface of a fixed length support arm.

Figure 2:
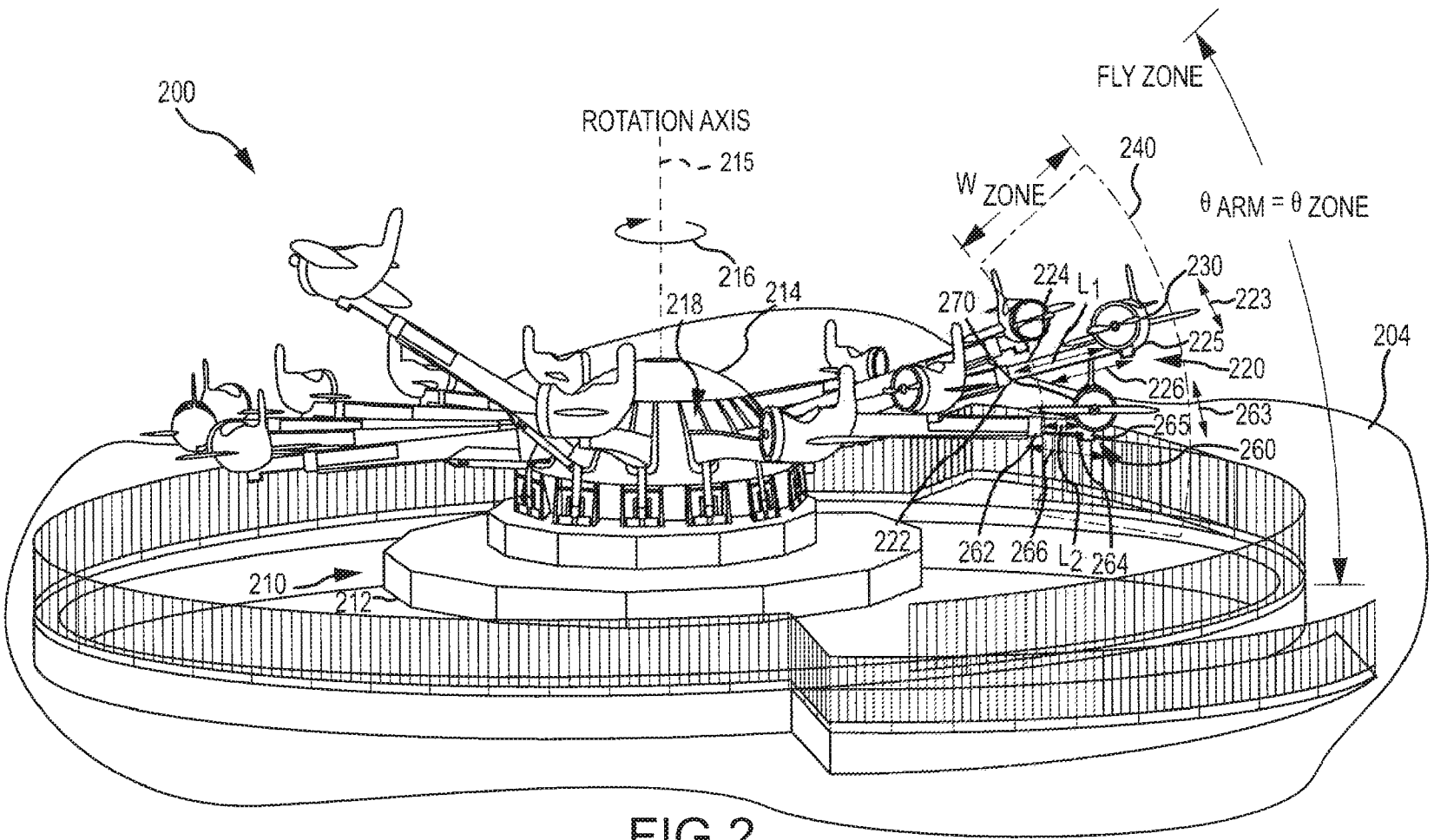
FIG. 2 illustrates a perspective view of a theme or amusement park ride (or, more simply, park ride) configured according to an embodiment during operations, e.g., after or during initial loading and rotation of the drive and support assembly (or central support and rotation assembly) showing a fly space or work zone for the vehicles provided on the ends of telescoping arm assemblies (e.g., the variable radius mechanism is provided via a telescoping arm in this embodiment)

FIG. 2 illustrates one implementation of a park ride 200 that may be used to provide the functionality described for ride 100 of FIG. 1. As shown, the ride 200 is similar in general appearance to a conventional round iron ride. The ride 200 includes a central support and rotation assembly 210 that includes a fixed/rigid base or platform 212 on the ground 204. A hub 214 is supported upon the base/platform 212 for rotation 216 about a central or rotation axis 215 (e.g., by a hub rotation mechanism/drive as shown at 108 of FIG. 1 in response to power or control signals 155 from a control system 150). The assembly 210 also includes pivot assembly 218 for supporting and pivoting a plurality of vehicle support arms 222, 262 so as to set their angular orientation and set/adjust 233, 263 the vertical position of vehicles 230, 270 (or their heights relative to the base 212 or the ground). The ride 200 has single passenger vehicles but other embodiments will have vehicles adapted for two or more passengers. In this case, each vehicle (e.g., airplane or the like) is supported at the end of a telescoping arm that is pivoted through arm angles by pivot assembly 218 and rotates 216 about rotation axis 215 with hub 214 (which supports pivot assembly 218).

Specifically, it may be useful to discuss a pair of vehicles and their movement in ride 200. As shown, the ride 200 includes a first vehicle 230 and a second vehicle 270 that is adjacent or trailing the lead vehicle 230. The first vehicle 230 is supported on a support arm assembly 220, and, specifically, at the end 225 of a telescoping arm or portion 224 that extends outward from pivoting arm or portion 222. The telescoping arm 224 has a length, $L_1$, that may be modified from a minimum value (e.g., fully withdrawn or retracted) to a maximum value (e.g., fully extended or telescoped outward). This telescoping action is shown with arrow 226, and the width, $W_{Zone}$, of the fly zone or work space 240 for the vehicle 230 is defined by amount of travel allowed for telescoping arm 224 (such as 0 to 15 feet with a fully extended/telescoped length, $L_1$, of about 5 feet being useful in some cases of ride 200). The pivoting or inner support arm 222 may be pivoted through a range of arm angles, $\theta_{Arm}$, that define the angular range or arc length of the fly zone or work space 240 (e.g., −30 degrees to +60 degrees or the like relative to a horizontal plane extending through the hub 214 parallel to ground 204), which causes changes 223 in the vertical position or height of the vehicle 230 (moves it up and down).

The trailing or second vehicle 270 is likewise supported by a support arm assembly 260. Specifically, the vehicle 270 is mounted to an end 265 of telescoping arm 264 that can be reciprocated 266 in and out (or along) the supporting or pivoting arm 262. This movement 266 sets and changes the length, $L_2$, of the telescoping arm and the radius of the vehicle 270 relative to the rotation axis 215 or hub 214. The pivoting arm 262 is supported on hub 214 by pivoting assembly 218, which moves 263 the vehicle 270 through the angular range, $\theta_{Arm}$, of the work space or fly zone 240, e.g., in response to control signals from a control signal that are generated based on parameters set by a ride program and/or based on processing of user input provided by a passenger of vehicle 270.

The movements 223, 263 may result in the vehicles 230, 270 being at the same or differing vertical positions or at differing heights within the work space 240. Further, the movements 226, 266 of the telescoping arms 224, 264 may result in the horizontal positions (and lengths, $L_1$ and $L_2$, and corresponding vehicle radii) being the same or different within the work space 240. Also, the vertical and horizontal movements for each vehicle 230, 270 may occur at the same time or separately (e.g., vehicles 230, 270 move independently and also for each such vehicle their vertical and horizontal movements may be concurrent or separate). In one application, ride 200 is operated in a "dogfight" mode in which trailing vehicle 270 is operated by its rider via input devices (such as a joystick) to try to choose its movements 263, 266 to align itself (horizontal and vertical position within work space 240) with the first or leading vehicle 230. When aligned, the vehicle 270 may "fire" upon the tail of vehicle 230 (such as with an IR emitter) while the vehicle 230 may be operated by its passenger(s) to try to avoid such alignment by making movements 223 and/or 226 to "lose" the vehicle 270.

Figure 3:
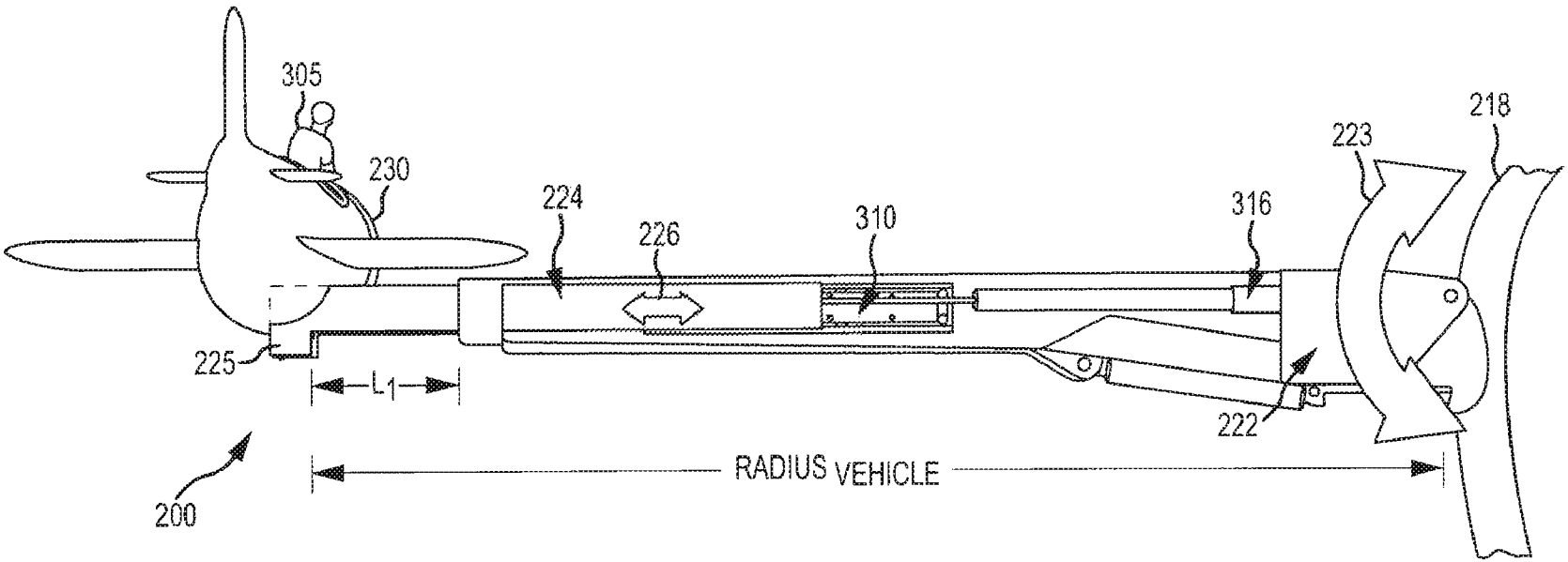
FIG. 3 illustrates a partial rear, sectional view of one of the vehicle and telescoping arms of the park ride shown in FIG. 2 showing additional details of the variable radius mechanism of an exemplary telescoping arm embodiment.

FIG. 3 illustrates a portion of the ride 200 in more details, and, specifically, it provides a sectional detail of support arm assembly 220. As can readily be seen from this sectional view, the ride 200 makes use of a plurality of arm assemblies such as assembly 220 that have a pivoting arm 222 supported by pivot assembly 218 in hub 214 and, significantly, that include telescoping components to change radius, $Radius_{Vehicle}$, of a supported vehicle 230 (e.g., to provide a variable radius mechanism 122 as shown in ride 100 of FIG. 1). In operation, a control system may set the radius, $Radius_{Vehicle}$, between a minimum value, with the telescoping arm 224 at a fully retracted position (e.g., with end 225 abutting against end of pivoting arm 222) or to a load/unload point, and a maximum value, with the telescoping arm 224 at a fully extended position (e.g., with a portion of the telescoping arm 224 contacting a stop in the telescoping guide assembly 310 provided in/on pivoting arm 222). The vehicle radius, $Radius_{Vehicle}$, may be set based on ride parameters (set by a ride program and parameters stored in memory) and/or based on input provided by a passenger 305 in the vehicle 230 (e.g., by operating a joystick, a touch screen, or the like). The pivoting assembly 218 also acts to pivot 223 the arm 222 so as to move the vehicle 230 through an angular range (or through various vertical positions or heights within a work space or fly zone).

The arm assembly 220 includes, in this exemplary but not limiting example, a telescoping guide assembly 310 within the pivoting arm 222, and the telescoping arm 224 is able to slide in/out or reciprocate 226 on the guide portion to set the exposed length, $L_1$, of the telescoping arm 224 (which defines/modifies the overall vehicle radius, $Radius_{Vehicle}$). The assembly 310 may include a telescoping guide and bearings may be used to allow the arm 224 to ride smoothly on this guide, and, further, the assembly 310 may include one or more stops so as to define at least a maximum extension of the arm 224 and, optionally, a maximum amount of retraction (or this may be provided by end 225 contacting an exterior portion of arm 222). A telescoping actuator 316 is connected to the telescoping arm 224 and is operable by the ride control system (e.g., in response to rider 305 input) to reciprocate 226 the arm on the guide 310 (e.g., along the linear displacement path defined on or within the pivoting arm 222 and which may coincide with the longitudinal axis of the arm 222). Note, although not shown, the vehicle 230 may also have an optional DOF at the end 225 of the arm 224 such as a roll DOF and/or a pitch DOF (e.g., the vehicle 230 may be pivotally mounted on the arm 224 or may be rigidly attached).

The actuation devices for each arm assembly 220 of ride 200 may be chosen from a wide range of devices to practice the ride 200. For example, the telescoping actuator 316 may be a pneumatic, an electric, a hydraulic, a combination of such devices, or other actuator. The arm actuation options for pivoting assembly 218 and/or for moving arm 224 (or vehicle 230 on pivoting arm 222 in some cases) may be an external linear actuator, a rack and motor driven pinion, a closed-loop cable/winch device, an LSM/LIM device, a combination of such arm actuation mechanisms, or the like. In rides 200 where the vehicle 230 is mounted for rolling, the rolling may be "free" or based upon gravity and system parameters (such as rotation rate, vehicle radius, $Radius_{Vehicle}$, and so on), e.g., a free pivot-type device provided at end 225 to connect vehicle 230 to arm 224. In other cases, though, the roll actuation options may include a mechanical linkage, a driven actuator (e.g., that follows a defined profile), or other actuation device to support desired amounts of roll for vehicle 230.

Figure 4:
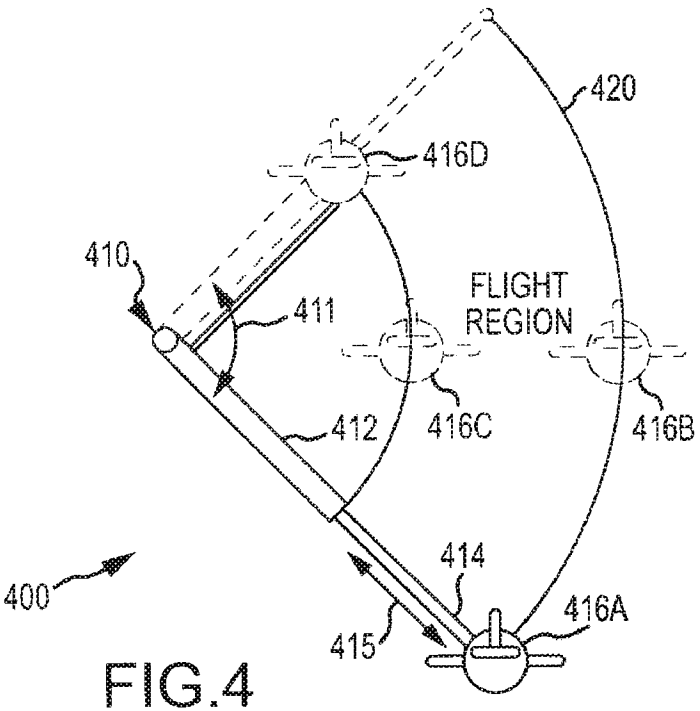
FIG. 4 is a schematic illustration of a park ride with controlled vehicle roll during arm extension (during varying magnitudes of arm extension or arm radii)

FIG. 4 illustrates a driven (or motorized) vehicle roll that may be coordinated with arm extension and/or with angular position of the pivoting arm. In a telescoping arm round ride 400, it may be desirable to provide coordinated roll motion with a motorized connection (not shown and a variety of such devices may be provided to achieve the described functionality) between the vehicle 416 and the extension or telescoping arm. Such a motorized, roll motion device/assembly may be designed to provide additional dynamics in the ride 400 and increase the unique "flying" experience of the telescoping arm.

As shown in FIG. 4, the ride 400 includes a support arm assembly 410 that would be pivotally mounted to a rotatable hub or central support structure. The arm assembly 410 includes a pivoting portion or arm 412 that is rotated or pivoted 411 through a range of arm angles so as to define a vehicle height and/or an arc length of a work space or fly zone 420 for a vehicle 416. A telescoping arm or arm extension 414 slidably engages and/or is supported on the telescoping arm 412 and is operable in assembly 410 to reciprocate 415 inward and outward toward the arm 412 to move the vehicle 415 through the work space 420 (e.g., to define a horizontal position of the vehicle 416 in work space 420).

A motorized vehicle roll control may be provided in the connection of the vehicle 416 to the arm 414 such that the vehicle 416 is in a particular roll position/orientation throughout the work space 420. For example, FIG. 4 illustrates that it may be desirable to roll the vehicle 416 as the arm 414 is extended out and retracted in and also as the pivoting arm 412 is pivoted 411 through a range of arm angles so as to maintain a particular position such as to keep the vehicle 416 level (or with its seats/wings in a horizontal plane parallel to the ground for example). This can be seen in action as the vehicle 416A is in a level or horizontal position with the pivoting arm 412 at a minimum or lowest angular position and with the telescoping arm 414 fully extended 415. If the arm 412 is then pivoted 411 upward to a midpoint in the angular range of work space 420, the roll control operates to maintain the vehicle 416B level or horizontal. If the telescoping arm 414 is then retracted 415 to a retracted or even a minimum position, the roll control acts to maintain the vehicle 416C in a level or horizontal position (in this angular position of arm 412 there may be no roll required). Then, when the pivoting arm 412 is pivoted 411 to a maximum or highest angular position in work space 420, the roll control functions to roll the vehicle 416D to again maintain it in its level or horizontal position.

Figure 5A:
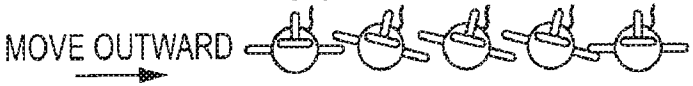
FIGS. 5A and 5B illustrates exemplary controlled roll of a vehicle during outward movement and inward movement, respectively (e.g., motorized vehicle roll coordinated with arm extension and retraction, respectively)
Figure 5B:
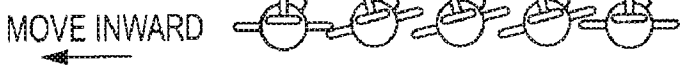

In other embodiments, it may be desirable for the roll control to provide a "banking" or active roll feeling for the passengers. To this end, FIGS. 5A and 5B show operation of a vehicle roll control assembly to cause the vehicle to roll during movement of the support arm assembly to extend/lengthen (FIG. 5A) and retract/shorten (FIG. 5B) a telescoping arm (such as arm 414 supported on pivoting arm 412). As the vehicle radius is increased or the vehicle is moved outward from an inner position 510 to an outer position 514 the vehicle is rolled (or rotated on its longitudinal axis) in a clockwise direction as shown at 511, 512, 513 before it is returned to its level or horizontal position (or another position used when there is no telescoping action). Hence, the vehicle 510, 514 is positioned similarly whenever the telescoping arm is stationary. FIG. 5B shows operation of the roll control assembly as the telescoping arm is retracted (e.g., the vehicle radius is reduced as the vehicle is moved inward toward the rotating central hub). As shown at 516, 517, 518, the vehicle is rolled (or rotated on its longitudinal axis aligned with a forward direction of travel) in a counterclockwise direction until it is returned at 519 to a level or horizontal position.

Figure 6:
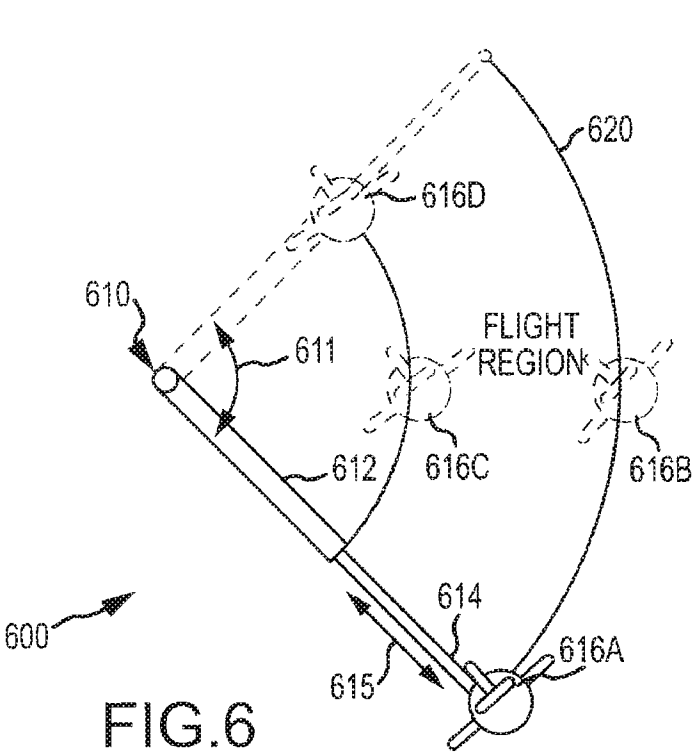
FIG. 6 illustrates a portion of park ride similar to that shown in FIG. 4 but with "free" vehicle roll being provided such as based on system dynamics (e.g., weight of vehicle and passenger(s), speed of rotation, magnitude of the vehicle radius, and the like)

In other cases, a ride 600 may be provided in which a vehicle 616 is mounted/supported upon the end of a telescoping arm 614 with "free" vehicle roll. In this ride 600, the vehicle 616 is able to roll "freely" (or with some mechanical or other restraints being provided) based on system dynamics In the ride 600, the support arm assembly 610 is pivoted 611 through a work space or fly zone 620 as the pivoting arm 612 is pivotally mounted to a rotating central hub or support structure (not shown in FIG. 6). A telescoping arm or arm extension 614 may be reciprocated (extended/retracted) 615 so as to move the vehicle 616 horizontally through the work space or fly zone 620. Due to rotation and other forces/dynamics (e.g., caused by rotation of the arm assembly 610), the vehicle may be banked or rolled counterclockwise in relation to the direction of travel of the vehicle or rotation of the hub. Extension or retraction 615 may cause some other roll movement such as shown in FIGS. 5A and 5B between the "default" positions shown in FIG. 6. As shown at 616A, 616B, 616C, and 616D, vehicle is rolled the same or similar amount about its longitudinal/travel axis in the counterclockwise direction (with travel into the page of the figure) when the arm 614 is stationary (such as fully extended out or fully retracted in to arm 612). In some cases, the amount of roll will vary, though, between the extended positions 616A, 616B and the retracted positions 616C, 616D due to system dynamics or forces applied to the vehicle during ride operation 600.

In some embodiments, as discussed above, the radius of the vehicle may be varied or changed in other ways (e.g., the variable radius mechanism may use devices/actuators other than a telescoping arm as shown in FIGS. 2 and 3). For example, FIG. 7 illustrates a portion of a ride 700 in which a support or pivoting arm 722 is pivotally 723 mounted at a first end 724 to a rotatable hub/support structure via pivoting assembly 718. The length of the arm 722 is fixed and the arm 722 extends from the first end 724 proximate to the hub to a distal, second end 726. Typically, the arm 722 is a rigid member such as with a rectangular or circular cross section designed as a cantilevered element that can support its own weight and also that of a vehicle 740 and its passengers 745.

The ride 700 includes for each vehicle 740 a variable radius mechanism 730 to allow the vehicle radius, $\text{Radius}_{Vehicle}$, to be set and changed during pivoting 723 and also rotation of the central hub as it rotates about a rotation axis for the ride 700. In operation, the vehicle 740 is securely captured/constrained to the arm 722 and is driven back and forth 726 along the length of the arm 722 (or a portion thereof) to define the vehicle radius, $\text{Radius}_{Vehicle}$. For example, as shown, the variable radius mechanism 730 may be provided to move/reciprocate 726 the vehicle 740 such as with a fixed rack gear 732 and driven pinion in the vehicle 740. The fixed rack gear or track 732 is provided, in this case, on an upper or outer surface 728 of the arm 722. In other cases, though, the variable radius mechanism or arm actuation device 730 may include pinch wheels, an LSM/LIM device, or other mechanism for retaining the vehicle 740 on the arm 722 during rotation of the hub and pivoting 723 of the arm while also providing linear displacement between the end 724 and end 726 (or a portion of the distance/space between these arm ends). Motion 723 and/or 726 may be controlled by the passenger(s) 745 in the vehicle 740 and/or by a show/ride programmed to a specific motion profile (e.g., by a hardware processor running a ride program code and accessing memory for ride parameters including movements 723, 726).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. In a ride, the vehicle position may be controllable through a 2-dimensional spaced instead of along a single arc. Multiple control elements may be made available in the vehicle or elsewhere to allow input from one, two, or more riders (or even others not in the vehicle). Vehicle movement may be controlled independent of rider/passenger inputs to create show effects or responses to gaming events. Guest sightlines may be improved in the rides since there is a smaller likelihood that adjacent vehicles will be in front of each other (e.g., be at the same radius or have the same support arm length), and riders have ability to control vehicle position to change/improve their sightlines during the ride. The ride design provides greater variation in ride dynamics since passengers are able to change their radial distance from the center of rotation (or hub/support structure rotation axis). The speed of linear displacement of the vehicle (changing of the vehicle radius) may be varied to practice the invention and may be varied to suit the expected passengers such as slower for younger children and faster for teenagers and adults (e.g., 0 to 5 feet/second for children and 0 to 15 ft/s for other rides or the like).

We claim:

1. An amusement park ride, comprising:

a central support assembly including a structure rotatable about a central axis at one or more rotation speeds;

a plurality of passenger vehicles; and for each of the passenger vehicles, a support arm assembly extending outward from the structure, wherein the support arm assembly includes a support arm and a variable radius mechanism, the support arm mounted to the rotatable structure and supporting the passenger vehicle at a distance from the rotatable structure and the variable radius mechanism operating during rotation of the rotatable structure to vary the distance from the support arm attachment on the rotatable structure to the passenger vehicle.

2. The ride of claim 1, wherein the variable radius mechanism comprises a telescoping arm upon which the passenger vehicle is mounted and an actuator, the telescoping arm slidably engaging the support arm and the actuator reciprocating the telescoping arm along a linear displacement path to vary the distance from the support arm attachment on the rotatable structure to the passenger vehicle.

3. The ride of claim 1, wherein the variable radius mechanism operates at least in part in response to input received from an input device provided in the passenger vehicle.

4. The ride of claim 1, wherein an actuator operates to vary the distance at a rate selected from the range of 0 to 15 feet/second and wherein the passenger vehicle is mounted on the arm to roll with the variation in the distance.

5. The ride of claim 1, further comprising a control system receiving ride information from each of the passenger vehicles and, in response, providing system feedback to each of the passenger vehicles to affect operation of the variable radius mechanism.

6. The ride of claim 1, wherein the support arm is pivotally mounted to the rotatable structure and is pivoted through a range of angular positions by a pivoting mechanism.

7. The ride of claim 6, wherein the pivoting mechanism operates at least in part in response to input received from an input device provided in the passenger vehicle.

8. The ride of claim 6, further comprising a control system receiving ride information from each of the passenger vehicles and, in response, providing system feedback to each of the passenger vehicles to affect operation of the pivoting mechanism.

9. The ride of claim 1, wherein the variable radius mechanisms are separately operable to independently vary the distances between the passenger vehicles and the rotatable structure.

10. An amusement park ride, comprising:

a central support assembly including a structure rotatable about a central axis at one or more rotation speeds;

a plurality of passenger vehicles; and for each of the passenger vehicles, a support arm assembly extending outward from the structure, wherein the support arm assembly includes a support arm and a variable radius mechanism, the support arm mounted to the rotatable structure and supporting the passenger vehicle at a distance from the rotatable structure and the variable radius mechanism operating during rotation of the rotatable structure to vary the distance from the support arm attachment on the rotatable structure to the passenger vehicle, wherein the variable radius mechanism comprises a fixed rack gear provided on a surface of the support arm and a drive mechanism on the passenger vehicle operable to move the vehicle along the fixed rack gear to vary the distance.

11. A round park ride that rotates a central hub structure about a central axis, comprising:

support arms each connected at a first end to the central hub structure and each being positionable in a plurality of angular positions relative to the central hub structure;

a vehicle supported upon each of the support arms; and on each of the support arms, means for moving, during the rotating of the central hub structure, the supported vehicle to a plurality of positions on the support arm between a minimum radius and a maximum radius, the radii being measured from the central hub structure.

12. The ride of claim 11, further comprising a ride control system transmitting control signals to the moving means to define a next one of the positions for each of the vehicles.

13. The ride of claim 12, wherein each of the vehicles includes an input device operable by a passenger and wherein the ride control system processes signals from the input device and, in response, generates the control signals for transmitting to the moving means.

14. The ride of claim 11, wherein the moving means comprises an actuator and a telescoping arm supporting the supported vehicle and linked to the support arm, the actuator operating to slide the telescoping arm linearly relative to the support arm.

15. The ride of claim 11, wherein moving means is operable concurrently with movement of corresponding support arm between two of the angular positions.

16. The ride of claim 11, further comprising, on each of the support arms, a vehicle roll control mechanism for controlling roll of the vehicle during operation of the moving means, whereby the vehicle rolls as the vehicle is moved between first and second ones of the radii.

17. A round park ride that rotates a central hub structure about a central axis, comprising:

support arms each connected at a first end to the central hub structure and each being positionable in a plurality of angular positions relative to the central hub structure;

a vehicle supported upon each of the support arms; and on each of the support arms, means for moving, during the rotating of the central hub structure, the supported vehicle to a plurality of positions on the support arm between a minimum radius and a maximum radius, the radii being measured from the central hub structure, wherein the moving means comprises a fixed rack gear extending along a surface of the support arm and a drive mechanism on the vehicle that engages the fixed rack gear and that selectively moves the vehicle from a first one of the positions to a second one of the positions.

18. A telescoping arm round ride, comprising:

a number of arms pivotally supported on a hub structure rotatable at a velocity about a rotation axis;

for each of the arms, an arm extension mounted on the support arm to be reciprocated along a linear displacement path by a telescoping actuator between a fully retracted position and a fully extended position; and for each of the arms, a passenger vehicle positioned on the arm extension, wherein during rotation of the hub structure each of the passenger vehicles is vertically and horizontally movable through a volumetric work space that extends about the rotation axis during rotation of the hub structure.

19. The round ride of claim 18, wherein, for each of the arms, a distance from the rotation axis to the passenger vehicle is extended by at least about 5 feet when the arm extension is moved from the fully retracted position to the fully extended position.

20. The round ride of claim 18, wherein the arm extension is reciprocated at a rate of at least about 5 feet per second.

21. The round ride of claim 18, wherein the telescoping actuator operates in response to input from a passenger in the passenger vehicle operating an input device.

22. The round ride of claim 21, wherein the input device is further operable to provide input for controlling operation of an arm pivoting assembly to pivot the arm to change a height of the passenger vehicle.

23. The round ride of claim 22, wherein each of the passenger vehicles includes two of the input devices separately operable by passengers in the passenger vehicles to change the height of the passenger vehicle by pivoting the arm and to operate the telescoping actuator to change the horizontal position of the passenger vehicle within the work space.

* * * * *